United States Patent [19]

Watanabe et al.

[11] Patent Number: 4,994,782

[45] Date of Patent: Feb. 19, 1991

[54] VARIABLE RESISTOR

[75] Inventors: Hiroyuki Watanabe; Hiroji Tani; Tsutomu Yokoi, all of Nagaokakyo, Japan

[73] Assignee: Murata Manufacturing Co., Ltd., Kyoto, Japan

[21] Appl. No.: 398,732

[22] Filed: Aug. 25, 1989

[30] Foreign Application Priority Data

Aug. 29, 1988 [JP] Japan ..... 63-215860

[51] Int. Cl.[5] ..... H01C 10/30; H01C 10/32; H01C 10/36

[52] U.S. Cl. ..... 338/160; 338/162; 338/172

[58] Field of Search ..... 338/160, 161, 162, 163, 338/164

[56] References Cited

U.S. PATENT DOCUMENTS 4,520,341 5/1985 Miyoshi et al. ..... 338/35

*Primary Examiner*—Bruce A. Reynolds

*Assistant Examiner*—Marvin M. Lateef

*Attorney, Agent, or Firm*—Wenderoth, Lind & Ponack

[57] ABSTRACT

A variable resistor comprising a substrate provided on the surface thereof with a resistor on which a sliding member is in slidable contact therewith. The substrate is formed of diallyl phthalic resin, and a carbon resistor formed with a predetermined shape is molded integrally on the surface of the resin substrate. The carbon resistor contains diallyl phthalic resin as a binder resin. Terminals and the carbon resistor molded on the resin substrate are electrically connected through conductive paste. A variable resistor with good physical characteristics is obtained that can be manufactured at low cost, with superior heat resistance, capable of mounting by flow soldering, and having a small rate of resistance value. In addition, since the resistor and the terminals are connected through the conductive paste, connecting strength thereof is not only brought about by physical pressure but reinforced by the adhesion of the conductive paste.

1 Claim, 4 Drawing Sheets

VARIABLE RESISTOR

Figure 1A:
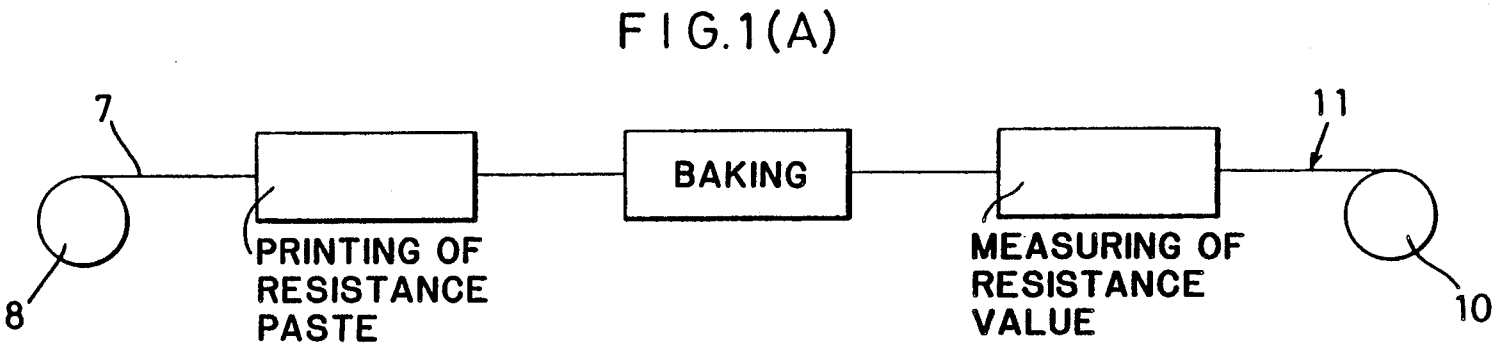

The present invention relates to a semifixed-type variable resistor comprising a substrate provided on the surface thereof with a resistor on which a sliding member is in slidable contact therewith.

In the conventional variable resistor, the substrate is formed of alumina and the resistor is of the cermet type comprising mainly $RuO_2$, so that a problem occurs in that, even though it has rather high reliability, it is expensive as a whole due to the fact that the alumina substrate is expensive in comparison with a resin substrate, a cermet resistor also has a high cost and, in addition, the manufacturing process is complicated.

In the case where a rather inexpensive carbon resistor is employed, the heat-resisting point of the substrate comprising Bakelite, glass/epoxy resin and polyphenylene sulfide resin, generally used in the conventional substrate, is around 180°~250° C., rendering it impossible to mount it by flow soldering. Thus, a combination of the carbon resistor and the alumina substrate is designed. However, a problem also occurs in that as a chip is small in volume so is the surface of the resistor, such that the resistor is not sufficiently adhered to the substrate, rendering it impossible to obtain physical characteristics of slidable contact, with the result that use of the alumina substrate raises the cost to that extent.

It has generally been practiced in the manufacturing process to carry out screen-printing directly on the surface of the substrate to fix thereon a resistor. In other words, on the surface of the resin-molded substrate, in which lead terminals have been embedded in advance, resistance paste is screen-printed with the predetermined shape, and dried and baked to fixedly secure the resistor.

With such manufacturing process: in fixing the resistor on the surface of the resin-molded substrate, a small amount of resistors were manufactured on an experimental basis from several lots of resistance paste; physical characteristics such as resistance value and the like were tested; and if the resisting characteristics met standard requirements, then mass-production thereof was started. The distribution of components in the resistance paste differed from each other, lot after lot, and moreover, different conditions under which the paste was printed, dried and baked, led to such a change in resistance characteristics of the resistor that confirmation of such characteristics meeting the standard requirements was needed, otherwise, all the manufacturing lots would have been deteriorated. It took 2 to 4 hours to manufacture the experimental resistors and test resistance characteristics thereof, during which time, the production line was stopped, thereby lowering productivity.

Furthermore, even after mass production thereof, drying of the resistance paste was carried out on the resin-molded substrate, in which the lead terminals connected to form integrally with hoop terminals were embedded, thereby requiring more space to be provided and production facilities to be on a bigger scale. In addition, a problem occurred in that, when the resin-molded substrate had an uneven surface on which the paste was to be printed, variation occurred in the resistance characteristics of the resistor thus formed.

Accordingly, it is an object of the present invention to provide a variable resistor superior in both quality and productivity without causing variation in resistance characteristics and the like.

It is another object of the present invention to provide a variable resistor with good characteristics capable of being manufactured at low cost and having a small rate of resistance value.

It is a further object of the present invention to provide a variable resistor capable of ensuring a strong connection of the resistor with the terminals through the conductive paste, having superior resistance against humidity, vibration and shock, and having little fluctuation in the resistance value.

It is a still further object of the present invention to provide a variable resistor capable of reducing the space required for its manufacture.

Figure 1B:
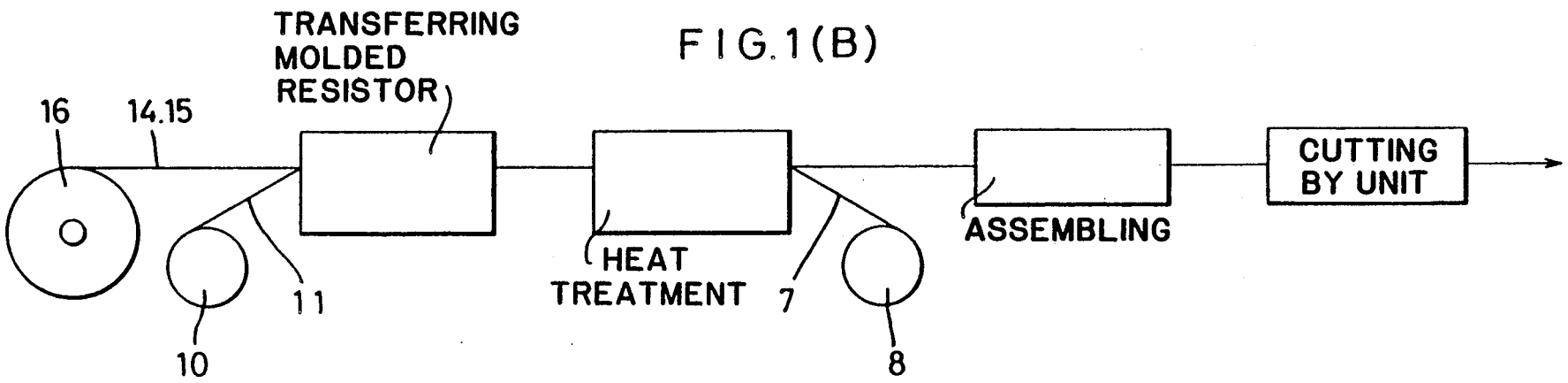
Figure 2A:
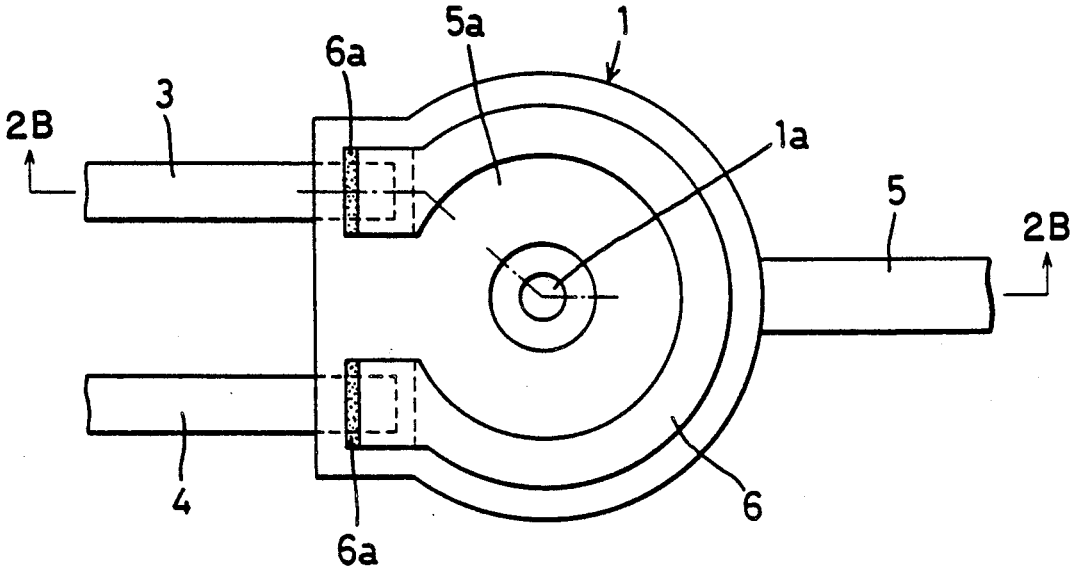
Figure 2B:
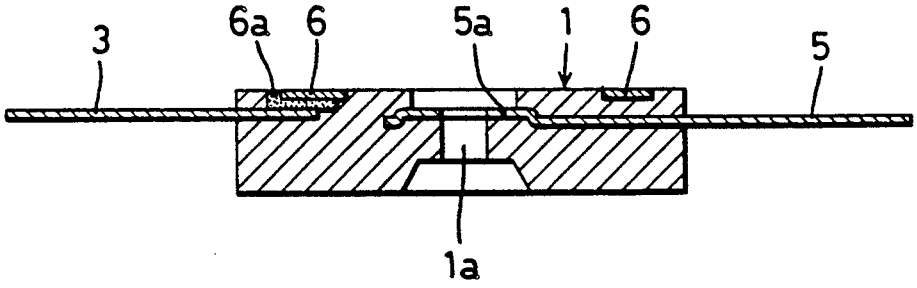

FIG. 1(A) is a flow diagram showing the manufacturing order of the transfer sheet used for the variable resistor according to the present invention, FIG. 1(B) is a flow diagram showing manufacturing and assembling of the resin substrate used for the variable resistor according to the present invention, FIG. 2(A) is a plan view showing the variable resistor according to the present invention, FIG. 2(B) is a sectional view of FIG. 2(A) taken along line 2B-2B.

Figure 2C:
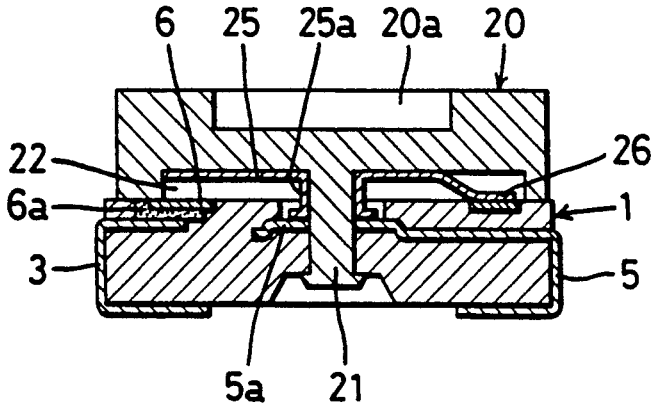
Figure 3:
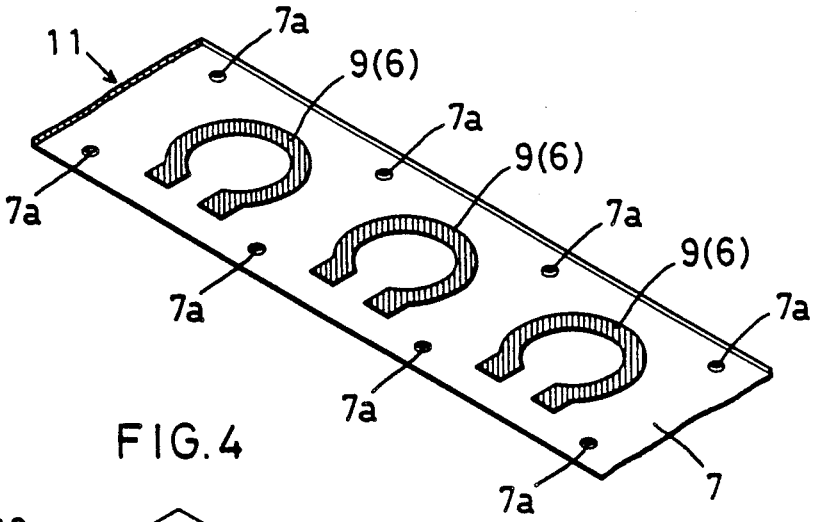
Figure 4:
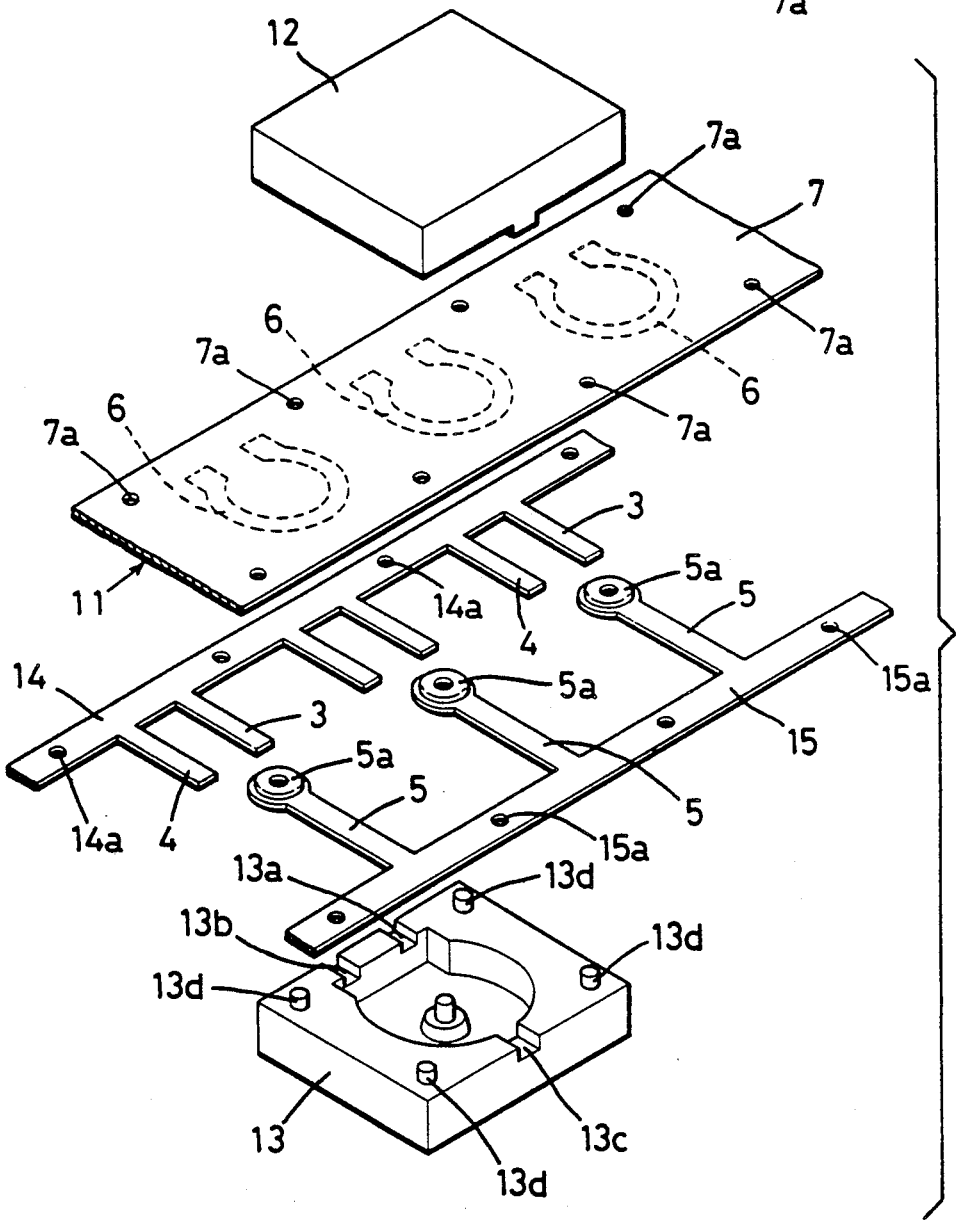
Figure 5:
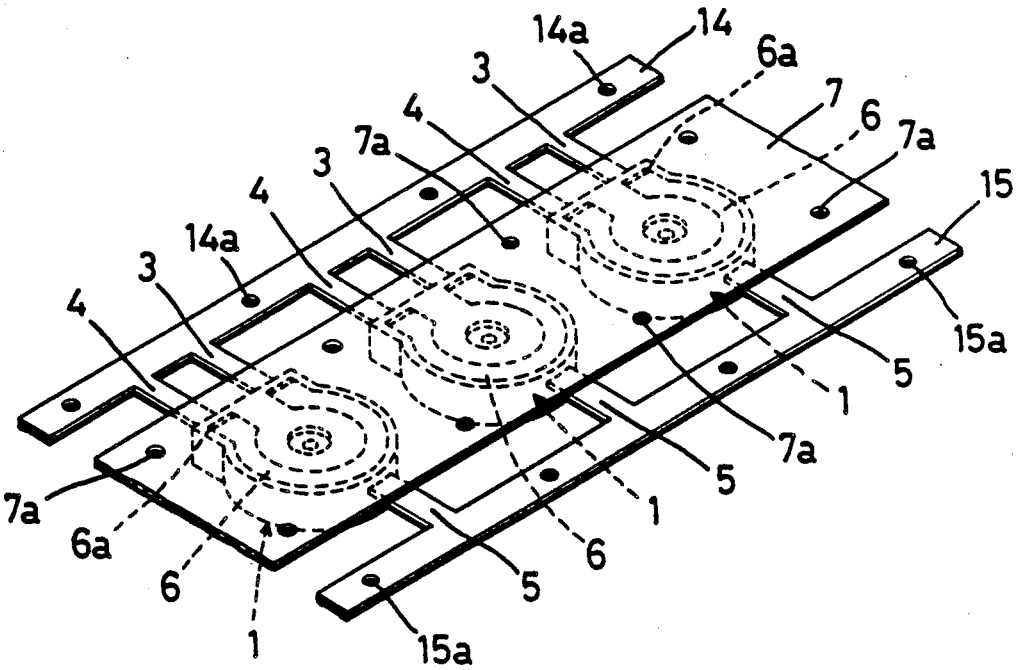
Figure 6:
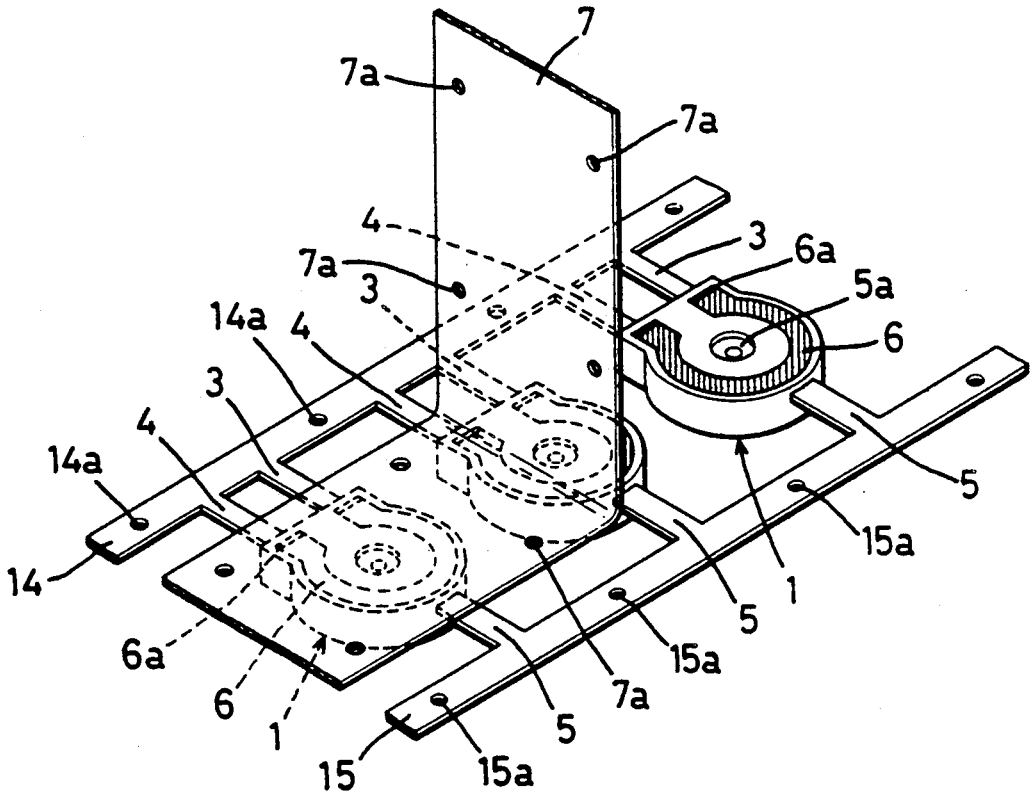

FIG. 2(C) is a longitudinal sectional view when the variable resistor in FIG. 2(A) is of a surface mount type, FIG. 3 is a perspective view explaining the manufacturing process of the transfer sheet, FIG. 4 is an exploded perspective view explaining the process of formation of the resin substrate, FIG. 5 is a perspective view showing the resin substrate when formed, and, FIG. 6 is a perspective view explaining how the heat-resisting film is being separated from the resin substrate.

In FIGS. 2(A) and 2(B), reference numeral 1 designates the resin substrate in which the lead terminals 3, 4 and 5 are embedded. The resin substrate 1 is so molded that it has on the surface thereof the carbon resistor 6 in such a manner as to be exposed on the same plane as the surface, and has a hole 1*a* substantially at the center thereof. The substrate 1 is formed of diallyl phthalic resin having a composition to be explained below Table 1.

The carbon resistor 6 provided on the surface of the resin substrate 1 is substantially like a circular arc. One end portion of each lead terminals 3, 4 is embedded in the resin substrate 1 so as to be electrically connected to the carbon resistor 6 at both ends thereof through conductive paste 6*a* while the other end portions of the lead terminals 3, 4 are led out of the substrate 1. The lead terminal 5 has an annular collector electrode portion 5*a* integrally formed at the one end thereof, so that the outer circumference of the electrode 5*a* is embedded at the inner circumference of the hole 1*a* provided in the resin substrate 1. The other end of the terminal 5 is led out of the substrate 1.

The substrate constructed as such is fitted with a rotor 20, as shown in FIG. 2(C), to be a variable resistor. In other words, the rotor 20 is integrally formed of such thermoplastic resin as polyphenylene sulfide, polyether ether ketone, and the like, the right surface of which is provided thereon with an adjusting groove 20*a* to be rotated by a driver and the like and on the rear surface thereof with a central shaft 21. The sliding member 25 is made up of conductive metal plate such as stainless steel, having a tubular shaft 25*a* at the center and a contact portion 26 at the peripheral area thereof.

The sliding member 25 is obtained by striking a hoop material one by one, and is insert-molded at a recess 22 on the rear surface when the rotor 20 is formed so as to be integrally and fixedly secured to the rotor 20.

The rotor 20 and the resin substrate 1 described above are assembled in an integral manner by inserting the central shaft 21 of the rotor 20 into the central hole 1*a* of the resin substrate 1, then deforming by heat the lower end portion of the central shaft 21 to be fixed. With this structure, the rotor 20 is rotatable with the central shaft 21 as a supporting point, and at the same time, the contact portion 26 of the sliding member 25 slides on the resistor 6. Resistance value is adjusted between the terminals 3 and 5, and, 4 and 5 by the angle of revolution of the sliding member 25. In addition, the sliding member 25 is pressed against the lead terminal 5 at the lower end of the tubular shaft portion 25*a* so as to be electrically connected.

The lead terminals 3, 4, and 5 of the above-described variable resistor are bent from the side to the rear surface of the resin substrate 1 so that the variable resistor can be of a chip-type capable of surface mounting.

Now, one embodiment is explained showing how the variable resistor constructed as above is manufactured.

A band-like heat-resisting film 7 is wound around a reel 8, as shown in FIG. 1(A) and FIG. 3. On the surface of the fiLm 7 thus fed successively from the reel 8 is the carbon paste 9 screen-printed at regular intervals with the face of the resistor 6 downward. Polyimide film may, for example, be used for the heat-resisting film 7, and carbon paste of a composition set forth below before Table 1 may be used for the resistance paste 9. The heat-resisting film 7 is provided at regular intervals with perforations 7*a* at both edge positions thereof, so that the holes 7*a* surely feed the film 7 at regular intervals to decide where to print the resistance paste 9 as well as to position the resistor 6 and the molds 12, 13 to be described later.

For the purpose of drying the resistance paste 9 printed on the film 7, the film is bent zigzag to give sufficient space to prevent the printed resistance paste 9 from being touched, or the film 7 is wound around the reel after which it is dried in a natural way or subjected to forced drying. In the example of the present invention, it is subjected to forced drying for about 5 minutes at 150° C.

After drying the resistance paste 9, heat-resisting film 7 is placed in an electric furnace where the paste 9 is baked on to the film 7, that is, in the example of the present invention, at a temperature of 260° C. and for 15 minutes. Resistance paste 9 is baked to be the resistor 6 later fixedly secured to the resin substrate 1.

As described above, the resistor 6 formed on the film 7 is checked to see whether, at this stage, the resistance characteristics meet standard requirements, and also to ascertain whether resistance paste 9 is in good condition with respect to distribution of components, printing, drying and baking. Test on the resistance characteristics of the resistor 6 is conducted with respect to the whole or a part thereof. When the resistance characteristics of the resistor 6 comes within the requirements, the film is wound around the reel 10 to be a transfer sheet 11. At this stage, various kinds of the transfer sheets 11 are provided ready to meet change requirements in the kinds of the various resistors.

The transfer sheet 11 fed out from the reel 10 and lead terminals 3, 4 and 5 are housed into the molds 12, 13 to be positioned. The lead terminals 3, 4 are connected to the hoop terminal 14, and the lead terminal 5 with the hoop terminal 15 in an integral manner respectively to be wound around the reel 16. The hoop terminals 14, 15 are provided with perforations 14*a*, 15*a* respectively thereby causing the terminals 14, 15 to be fed at regular intervals to be housed into the molds 12, 13. The lead terminals 3, 4 and 5 are fitted into the grooves 13*a*, 13*b* and 13*c* formed on the mold 13 to be positioned, while the perforations 7*a* formed on the heat-resisting film 7 are inserted by the bosses 13*d* projecting from the mold 13 in such a manner that the transfer sheet 11 is positioned.

When the transfer sheet 11 and the lead terminals 3, 4 and 5 are positioned and the molds 12, 13 are closed, molten diallyl phthalate resin fills the molds and then cures.

By curing of the resin, the resin substrate 1 is formed in which the lead terminals 3, 4 and 5 are embedded inside and on the surface thereof the carbon resistor 6 and the heat-resisting film 7 are fixedly secured, as shown in FIG. 5. In this way, the resin substrate 1 is formed one by one using the molds 12, 13 and fed out therefrom under the condition that it is being connected with the hoop terminals 14, 15 and the heat-resisting film 7.

The resin substrate 1 is subjected to heat treatment and degassing, if necessary (See FIG. 1(B)).

Next, the heat-resisting film 7 is separated from the resin substrate 1 connected to the hoop terminals 14, 15, as shown in FIG. 6. And yet the carbon resistor 6 is not separated from the surface of the substrate 1, due to the fact that it is fixedly secured on the surface of the substrate 1 in such a way as to be exposed on the same plane as the surface thereof.

Moreover, since the carbon resistor 6 formed on the heat-resisting film 7 and having a uniform thickness is fixedly secured (transferred) to the surface of the resin substrate 1, no variation in resistance characteristics occurs.

Above-described conductive paste 6*a* is applied between the resistor 6 and the lead terminals 3, 4 at the time of inserting them into the molds 12, 13, and is completely cured concurrent with the curing of the resin substrate 1. Thus, the resistor 6 and the lead terminals 3, 4 are strongly connected by contact force of a supporting pin acting on the back at the time of formation of the resin substrate 1, a second force due to curing of the substrate 1 and a third force through adhesion of the conductive paste 6*a*.

In order to increase the adhesion force between the resistor, the lead terminals 3, 4 and the conductive paste 6*a* to heighten reliability, treatment using silane coupling agent and silicon primer treatment may be given before inserting the resistor 6, and the lead terminals 3, 4 into the molds.

Then, the heat-resisting film is separated, and the above-described rotor 20 having the sliding member 25 is fitted on the carbon resistor 6 exposed on the surface of the resin substrate 1.

As above, necessary parts are fixed to the resin substrate 1, after which the hoop terminals 14, 15 connecting the substrate 1 are cut off from the lead terminals 3, 4 and 5 respectively to obtain the variable resistor.

Here, the composition and the effect of the carbon resistor 6 and the resin substrate 1, are explained in detail referring to the Table 1.

For the carbon resistor, a paste-like substance comprising:

As main component 8.0~70.0 wt % of graphite
As resistance regulator 0~40.0 wt % of inorganic filler
Binder resin 30.0~70.0 wt %
Thermosetting agent (for example, such organic peroxide as tertiary butyle benzoate, dicumyl peroxide, butyl peroxide and the like), 1.0~5.0 wt % with respect to above-mentioned binder resin
As solvent, proper amount of ethyl carbinol acetate was added
For the resin substrate:
As main component,
40 wt % of diallyl phthalic resin,
30 wt % of inorganic filler,
30 wt % of glass filament,
With respect to diallyl phthalic resin, 1~5 wt % of each of the thermosetting agents described before was used.
The above components were mixed, kneaded and used.

TABLE 1

| | Example ① | Example ② | Comparative Example ① | Comparative Example ② | Comparative Example ③ | Comparative Example ④ |
|---|---|---|---|---|---|---|
| Resistance paste binder resin | diallyl phthalate | diallyl phthalate | diallyl phthalate | phenol | diallyl phthalate | diallyl phthalate |
| Resin substrate | diallyl phthalate | diallyl phthalate | alumina | diallyl phthalate | poly-phenylene sulfide | glass/epoxy |
| Resistance value | 260 Ω | 200k Ω | 200k Ω | 200k Ω | 200k Ω | 200k Ω |
| TCR −40° C./+125° C. | −204/+210 | −111/+170 | −240/+433 | −260/+108 | −343/+281 | −421/+311 |
| Rate of resistance value in dip soldering | | | | | | |
| 230° C. | −0.86% | +0.96% | +8.65% | +5.23% | +13.16% | +14.65% |
| 270° C. | −1.5% | +2.05% | +23.01% | air bubble generated | substrate deformed | color of substrate changed |

As is apparent from the table above, temperature coefficient of resistance (TCR) in the examples ①,② was small in comparison with comparative examples ①~④, and there was also a small rate of resistance value in dip soldering. Especially, in the comparative example ②, air bubble was generated, in ③ the substrate was deformed and in ④ color of the substrate was changed, whereby it is clear that those in the comparative examples are inferior with respect to flow soldering.

In addition, those in each example ①,② had almost no change against trichloroethane ultrasonic cleaning, and were good.

On the other hand, the conductive paste 6a connecting the resistor 6 and the terminals 3, 4 is obtained by dispersing in the resin such conductive components as silver, carbon black and the like. It is preferable to use for the resin such thermosetting resin having strong adhesion as diallyl phthalic resin, epoxy resin and the like which are completely cured through formation of the substrate and heat treatment.

Table 2 shows the result of experiments of the conductive paste 6a together with a comparative example.

TABLE 2

| | Example 1 of experiment | Example 2 of experiment | Comparative example |
|---|---|---|---|
| Conductive paste | silver | carbon black | Nil |
| Advance treatment for terminals | dipped in silane coupling agent | Nil | Nil |
| Rate of resistance value | | | |
| Test for leaving in high temperature and high humidity 60° C., 95% RH, 500 Hour | +2.48 | +1.5% | +8.9% |
| Vibration test | +0.9% | +1.5% | +3.7% |

In the example 1 of the experiment, silver was used for the conductive paste 6a as conductive component. Treatment by silane coupling agent was given in advance to the lead terminals 3, 4. In the example 2 of the experiment, carbon was used as conductive component, but the treatment was not given beforehand to the terminals 3, 4. The comparative example is the case in which the resistor 6 and the lead terminals 3, 4 were connected directly without using conductive paste 6a.

In the test of leaving the paste in high temperature and high humidity and, also vibration test, the conductive paste 6a showed good characteristics in change in resistance value with respect to the comparative example, as shown in the examples 1, 2 of the experiment. In the vibration test of the comparative example, about 10% of the materials used for the experiment caused a gap to be created between the resistor 6 and the lead terminals 3, 4 thereby bringing about inferior connection, so that the value of the resistor could not be measured.

Although the variable resistor and manufacturing method for the same according to the present invention have been described in detail, the invention is not limited by the above-described examples but may be changed in various ways within the scope of the invention.

For example, the variable resistor is not limited by the embodiment shown in FIG. 2, but may be one in which the resistor is formed in the inner surface of the cylinder.

Moreover, although polyimide film superior in heat resistance and stable in size, is preferable for the heat-resisting film, films formed of imide resin composite or other materials superior in heat resistance may be used.

Or, it may be possible to chemically process the heat-resisting film on which the carbon resistor is formed, thereby enabling the film to be separated easily from the resistor, or to provide such treatment to the resistor on the heat-resisting film as silane coupling agent or silicon primer, thus heightening adhesion between the resistor and the resin substrate and improving transferability.

It may also be possible to fix lead terminals 3, 4 and the resistor 6 in such a manner that they are not overlapped in a direction of thickness and yet electrically connected through the conductive paste 6*a*. The resistor 6 is more fragile than the lead terminals 3, 4 so as to be subject to stress and cracks when resin substrate 1 cures. But this method will prevent cracks from occurring. In other words, the conductive paste 6*a* serves as a buffer against stress.

As is apparent from the explanation above, since, in this invention, the carbon resistor comprising diallyl phthalic resin as binder resin is used for the resistor, and diallyl phthalic resin for the substrate, it is possible to obtain a variable resistor, capable of being manufactured at low cost, supported by excellent heat-resisting diallyl phthalic resin, enabling mounting by flow soldering to be conducted and yet having a small change in rate of resistance value. In addition, the structure is such that the resistor and the terminals are connected through the conductive paste, enabling them to be connected also through adhesion of the conductive paste with the result that an extremely stable, strong adhesion can be obtained. Thus, a variable resistor superior in resistance against humidity, vibration, shock and the like, having almost no variation in resistance value, is obtained.

In the present invention, the substrate is formed of resin, so that, together with the formation thereof, the carbon resistor formed on the transfer sheet may now be transferred on the surface of the resin substrate. This manufacturing method enables resistance characteristics of the carbon resistor transferred to the surface of the resin substrate to be checked on the transfer sheet when the sheet is formed, thereby enabling products for experimental use to be mass-produced. Accordingly, there is no need of stopping the production line to check resistance characteristics of the carbon resistor, thereby improving productivity remarkably to provide a variable resistor at lower cost.

Drying operation for the resistance paste can be conducted in a small space, and, moreover, space for keeping the resin substrates before formation thereof can be done without, thus space for the whole manufacturing facilities can be reduced.

Furthermore, when the carbon resistor, which is formed on the transfer sheet, comprising diallyl phthalic resin as binder resin is transferred to the substrate also comprising diallyl phthalic resin, variation may be prevented from occurring in the resistance characteristics of the resistor to provide a variable resistor superior in resistance characteristics and having good quality.

What is claimed is:

1. A variable resistor comprising a resin substrate provided on the surface thereof with a resistor on which a sliding member is in slidable contact therewith, wherein said resistor is a carbon resistor integrally molded with a predetermined shape on the surface of the resin substrate and comprising diallyl phthalic binder resin, said resin substrate is formed of diallyl phthalic resin, and terminals are molded on said resin substrate and said carbon resistor and are electrically connected through conductive paste.

* * * * *